US012115571B2

(12) United States Patent
Kariyazaki et al.

(10) Patent No.: US 12,115,571 B2
(45) Date of Patent: Oct. 15, 2024

(54) PRESS-FORMING METHOD, BLANK MEMBER FOR SHEET-SHAPED MATERIAL, INTERMEDIATE FORMED PRODUCT, METHOD FOR MANUFACTURING PRESS-FORMED PRODUCT, AND PRESS-FORMED PRODUCT

(71) Applicant: JFE Steel Corporation, Tokyo (JP)

(72) Inventors: Yuta Kariyazaki, Tokyo (JP); Toyohisa Shinmiya, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 608 days.

(21) Appl. No.: 17/417,217

(22) PCT Filed: Dec. 9, 2019

(86) PCT No.: PCT/JP2019/048026
§ 371 (c)(1),
(2) Date: Jun. 22, 2021

(87) PCT Pub. No.: WO2020/144995
PCT Pub. Date: Jul. 16, 2020

(65) Prior Publication Data

US 2022/0048088 A1 Feb. 17, 2022

(30) Foreign Application Priority Data

Jan. 11, 2019 (JP) ..... 2019-003793
Jan. 11, 2019 (JP) ..... 2019-003819
Sep. 3, 2019 (JP) ..... 2019-160018

(51) Int. Cl.
*B21D 19/12* (2006.01)
*B21D 22/26* (2006.01)
*B21D 53/88* (2006.01)

(52) U.S. Cl.
CPC ..... *B21D 19/12* (2013.01); *B21D 22/26* (2013.01); *B21D 53/88* (2013.01)

(58) Field of Classification Search
CPC ..... B21D 19/12; B21D 22/20; B21D 22/26; B21D 53/88
See application file for complete search history.

(56) References Cited

U.S. PATENT DOCUMENTS

2003/0037586 A1 2/2003 Durney et al.
2013/0213109 A1 8/2013 Ogasawara
(Continued)

FOREIGN PATENT DOCUMENTS

AU 529459 B2 6/1983
CN 1703289 A 11/2005
(Continued)

OTHER PUBLICATIONS

Extended European Search Report for European Application No. 19 909 134.9, dated Feb. 1, 2022, 9 pages.
(Continued)

*Primary Examiner* — Teresa M Ekiert
(74) *Attorney, Agent, or Firm* — Buchanan Ingersoll & Rooney PC

(57) ABSTRACT

A method for manufacturing a press-formed product includes a blanking step of blanking from a sheet-shaped material into a shape in which an excess material portion is added to the contour outline of a developed shape of the press-formed product, a first pressing step of folding the excess material portion to form straight sides into an intermediate formed product with a bent flange portion, a second pressing step of performing press forming including bulging in which the bulging portion is provided on the intermediate formed product, and a trimming step of trimming the excess material portion. A blank material includes excess material
(Continued)

portion to be folded to form straight sides circumscribed around or spaced apart from a contour outline of a developed shape of the press-formed product, and an intermediate formed product includes excess material portion including a bent flange portion folded to form straight sides.

18 Claims, 10 Drawing Sheets

(56) References Cited

U.S. PATENT DOCUMENTS

| | | | | |
|---|---|---|---|---|
| 2013/0239645 | A1* | 9/2013 | Tanaka | B21D 22/26 72/352 |
| 2013/0316132 | A1* | 11/2013 | Yuasa | B21D 22/022 428/132 |
| 2016/0082495 | A1 | 3/2016 | Miyagi et al. | |
| 2016/0121384 | A1 | 5/2016 | Sumikawa et al. | |
| 2018/0085811 | A1 | 3/2018 | Fujii et al. | |
| 2018/0264534 | A1* | 9/2018 | Aso | B21D 22/26 |

FOREIGN PATENT DOCUMENTS

| | | | |
|---|---|---|---|
| CN | 1954934 | A | 5/2007 |
| CN | 105188982 | A | 12/2015 |
| CN | 105358269 | A | 2/2016 |
| CN | 107405668 | A | 11/2017 |
| CN | 108698105 | A | 10/2018 |
| JP | 5897428 | A | 6/1983 |
| JP | 0237248 | B2 | 8/1990 |
| JP | 0751761 | A | 2/1995 |
| JP | 0970626 | A | 3/1997 |
| JP | 11277155 | A | 10/1999 |
| JP | 3547862 | B2 | 7/2004 |
| JP | 2009255117 | A | 11/2009 |
| JP | 2013169578 | A | 9/2013 |
| JP | 6176430 | B1 | 8/2017 |
| WO | 2016203904 | A1 | 12/2016 |
| WO | 2017038579 | A1 | 3/2017 |

OTHER PUBLICATIONS

Chinese Office Action for Chinese Application No. 201980088564.6, dated Sep. 30, 2022, with translation, 14 pages.

International Search Report and Written Opinion for International Application No. PCT/JP2019/048026 dated Jan. 28, 2020, 5 pages.

Korean Office Action for Korean Application No. 10-2021-7018986, dated Apr. 19, 2022, with Concise Statement of Relevance of Office Action, 7 pages.

* cited by examiner

PRESS-FORMING METHOD, BLANK MEMBER FOR SHEET-SHAPED MATERIAL, INTERMEDIATE FORMED PRODUCT, METHOD FOR MANUFACTURING PRESS-FORMED PRODUCT, AND PRESS-FORMED PRODUCT

CROSS REFERENCE TO RELATED APPLICATIONS

The is the U.S. National Phase application of PCT/JP2019/048026, filed Dec. 9, 2019, which claims priority to Japanese Patent Application No. 2019-003793, filed Jan. 11, 2019, Japanese Patent Application No. 2019-003819, filed Jan. 11, 2019 and Japanese Patent Application No. 2019-160018, filed Sep. 3, 2019, the disclosures of these applications being incorporated herein by reference in their entireties for all purposes.

FIELD OF THE INVENTION

The present invention relates to a press-forming method that reduces springback occurring during press forming of a sheet-shaped material including a plurality of press-forming steps to improve dimensional accuracy of a press-formed product, and also relates to a blank material and an intermediate formed product used for the press forming, a method for manufacturing a press-formed product, and a press-formed product formed by the press-forming method.

BACKGROUND OF THE INVENTION

Due to energy problems and global environmental problems, there has recently been an increasing demand for a reduction in the weights of automotive bodies intended to improve fuel efficiency. On the other hand, for protection of passengers at the time of a collision, a demand for improvement of collision characteristics, for example, the rigidity of automotive bodies, has also been growing year by year. To respond to the two conflicting demands, expansion of application of high-strength steel sheets has been under way. Application of high-strength steel sheets enables an increase in the strength and rigidity of automotive bodies and in absorption energy at the time of a collision without an increase in sheet thickness.

However, press forming typically often used to process automotive parts disadvantageously involves poor shape fixability referred to as springback. Springback occurs when a press-formed product that has been obtained by press forming a steel sheet used as a sheet-shaped material is released from a die, and becomes larger with increasing material strength of a steel sheet. Springback causes defective welding during assembly as well as degrading appearance quality, and thus springback measures are essential for expansion of application of high-strength steel sheets.

Springback is caused by elastic recovery resulting from release of a bending moment, which is generated due to uneven residual stress, when a press-formed product is removed from a die. Thus, for example, methods for mitigating the unevenness of the residual stress have been proposed as springback measures.

Patent Literature 1 proposes a method including forming an intermediate product with an emboss disposed in a stretch flange portion and an excess bead disposed in a shrink flange portion, and in forming of a final formed product, collapsing the emboss to apply compressive stress to the stretch flange portion, while using the excess bead to apply tensile stress to the shrink flange portion, thus leveling the distribution of residual stress in a press-formed product.

Patent Literature 2 proposes a method in which, when a metal sheet is press-formed into a product shape having a top sheet portion and a flange portion that are connected across a side wall portion in a width direction and that have a hat-shaped cross section in which the top sheet portion and the flange portion are curved in such a manner as to protrude or be recessed toward the top sheet portion along a longitudinal direction, press forming is performed in such a manner as to obtain a radius of curvature smaller than that of the product shape to produce an intermediate part, and the intermediate part is press-formed into the product shape, thus reducing a bending moment caused by a stress difference between the top sheet portion and the flange portion to suppress camber back.

Patent Literature 3 proposes a method in which, in a press-formed product including, in at least a part of the periphery of a flat portion, a flange portion folded approximately at a right angle, a plurality of triangular beads are formed along edges of the flange portion of the press-formed product to correct flatness.

PATENT LITERATURE

Patent Literature 1: Japanese Patent Laid-Open No. 2009-255117

Patent Literature 2: Japanese Patent No. 6176430

Patent Literature 3: Japanese Patent Laid-Open No. H11-277155

SUMMARY OF THE INVENTION

Although Patent Literature 1 proposes, as a method for levelling the residual stress, a method of forming the emboss in the stretch flange portion and forming the excess bead in the shrink portion, low-rigidity parts to which aspects of the present invention are mainly directed suffer from springback even at low stress, and reducing the stress in the particular portion may be insufficient. Additionally, in a new stress state resulting from the reduction in the stress in the particular portion, another form of springback may occur.

Although Patent Literature 2 deals with the case in which the continuous hat shape is curved, the low-rigidity parts to which aspects of the present invention are mainly directed are small in forming depth and have a stress state varying significantly depending on the presence or absence of a bulging shape of the top sheet portion. This prevents stress reduction from being achieved using a uniform method as in the technique in Patent Literature 2.

The measure in Patent Literature 3 may be insufficient because some of the low-rigidity parts include no edge with a bent flange, and the low rigidity of such a portion may degrade the flatness of the entire panel.

That is, the problems of the related art to be solved are listed below.

(1) To provide a press-forming method that is effective for suppressing springback in parts with low form rigidity.

(2) To provide a press-forming method that is applicable regardless of the shape of parts.

Aspects of the present invention are made in view of these problems, and an object thereof is to easily manufacture an intermediate formed product shape effective in springback suppression measures by improving rigidity of parts, and a product having a small amount of springback after press forming and a high shape freezing property.

As a result of dedicated studies, the inventors of the present invention have found that a surplus material resulting from excessive inflow of a material adversely affects the distortion of a formed product panel that has been caused by springback of low-rigidity parts, and, to suppress the inflow of the material, developed a technique of folding a flange of an excess material to form straight sides so as to suppress the inflow of the material in the next forming step by bending and unbending resistance of the folded portion.

To advantageously solve the problems described above, aspects of the present invention provide a press-forming method for press forming a sheet-shaped material into a press-formed product with a bulging portion, characterized by including a first pressing step of folding an excess material portion provided in the sheet-shaped material to form straight sides into an intermediate formed product with a bent flange portion, and a second pressing step of performing press forming including bulging of providing the bulging portion on the intermediate formed product.

Note that the press-forming method according to aspects of the present invention may have preferred solutions as follows:

(a) the press-forming method includes, before the first pressing step, a blank shape determination step of determining, in accordance with a previously identified amount of inflow material during press forming, a blank shape in which an excess material portion is added to a contour outline of a developed shape of the press-formed product, (b) the bent flange portion has an L- or a Z-shaped cross section, (c) the bent flange portion has a Z-shaped cross section, and a flat vertical wall portion resulting from the folding in the first pressing step is extended in a height direction in the second pressing step, (d) an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion when projected on a plane including the flat sheet portion, and (e) in the first pressing step, the excess material portion is folded to form straight sides that are circumscribed around or spaced apart from a contour outline of the developed shape of the above-described press-formed product.

A blank material of a sheet-shaped material according to aspects of the present invention which advantageously solves the above-described problems is characterized by including an excess material portion used for the press-forming method.

It may be considered to be a preferable solution that the excess material portion of the blank material of the sheet-shaped material according to aspects of the present invention is provided with a notch at a connection portion between adjacent straight sides.

An intermediate formed product according to aspects of the present invention that advantageously solves the problems is the intermediate formed product in the press-forming method, which is characterized by having a bent flange portion folded to form straight sides in the excess material portion.

It may be considered to be a preferred solution that the bent flange portion of the intermediate formed product according to aspects of the present invention has an L- or a Z-shaped cross section.

A method for manufacturing a press-formed product that advantageously solves the above-described problems is a method for manufacturing a press-formed product with a bulging portion from a sheet-shaped material including a blanking step of blanking the sheet-shaped material into a shape in which an excess material portion is added to a contour outline of a developed shape of the press-formed product, a first pressing step of folding the excess material portion to form straight sides into an intermediate formed product with a bent flange portion, a second pressing step of performing press forming including bulging in which the bulging portion is provided on the intermediate formed product, and a trimming step of trimming the excess material portion.

Note that the method for manufacturing a press-formed product according to aspects of the present invention may include preferred solutions as follows:

(a) before the blanking step, a blank shape determination step of determining a blank shape having a shape in which an excess material portion is added to a contour outline of the developed shape of the press-formed product, in accordance with a pre-specified amount of inflow material during press forming, (b) the bent flange portion has an L- or a Z-shaped cross section, (c) the bent flange portion has a Z-shaped cross section, and a flat vertical wall portion resulting from the folding in the above-described first pressing step is extended in a height direction in the above-described second pressing step, (d) an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion projected on a plane including the flat sheet portion, and (e) in the first pressing step, the excess material portion is folded to form straight sides that are circumscribed around or spaced apart from a contour outline of the developed shape of the press-formed product.

Furthermore, a press-formed product according to aspects of the present invention that advantageously solves the problems is obtained by the press forming in accordance with any one of the press-forming methods.

The press-forming method according to aspects of the present invention allows a press-formed product to be formed without distortion by folding a flange of an excess material to form straight sides, preferably into an L or a Z shape by bending deformation, and holding the resulted bent flange portion between an upper die and a lower die or with a blank holder to suppress inflow of a material during bulging using resistance caused by bending and unbending.

Moreover, the press-forming method according to aspects of the present invention has only to extend the blank only at the flange portion to be folded, leading to a higher material yield than normal draw forming. Also, by determining a portion to be provided with the excess material portion beforehand, press forming can be carried out with more reduced waste of materials. Then, the bent flange portion has a Z shape and the flat vertical wall portion of the bent flange portion is extended to absorb the deflection of the flat sheet portion, allowing the press-formed product to be formed more accurately.

The blank material according to aspects of the present invention can be suitably applied to the press-forming method according to aspects of the present invention, and the intermediate formed product according to aspects of the present invention can be processed with springback reduced in the subsequent pressing step.

In the method for manufacturing a press-formed product according to aspects of the present invention, a final product shape can be formed without distortion by conducting trimming.

The press-formed product according to aspects of the present invention is press formed in accordance with the press-forming method according to aspects of the present invention, thus allowing possible springback to be efficiently suppressed.

BRIEF DESCRIPTION OF THE DRAWINGS

FIG. 1(*a*) illustrates that $\alpha=90°$, FIG. 1(*b*) illustrates that $\alpha<90°$, and FIG. 1(*c*) illustrates that $\alpha>90°$.

FIG. 2(*a*) illustrates that $\alpha=\beta=90°$, FIG. 2(*b*) illustrates that $\alpha=90°$ and $\beta>90°$, FIG. 2(*c*) illustrates that $\alpha=90°$ and $\beta<90°$, FIG. 2(*d*) illustrates that $\alpha>90°$ and $\beta=90°$, FIG. 2(*e*) illustrates that $\alpha<90°$ and $\beta=90°$, FIG. 2(*f*) illustrates that $\alpha>90°$ and $\beta>90°$, FIG. 2(*g*) illustrates that $\alpha>90°$ and $\beta<90°$, FIG. 2(*h*) illustrates that $\alpha<90°$ and $\beta>90°$, and FIG. 2(*i*) illustrates that $\alpha<90°$ and $\beta<90°$.

FIG. 11(*a*) is a schematic partial cross-sectional view of the state after a first pressing step, and FIG. 11(*b*) is a schematic partial cross-sectional view of the state after a second pressing step.

DETAILED DESCRIPTION OF EMBODIMENTS OF THE INVENTION

Figure 1A:
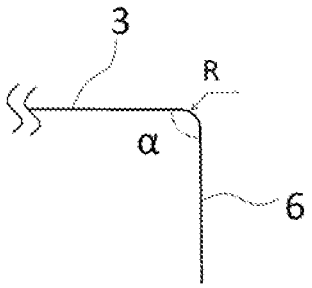
FIG. 1 is a partial cross-sectional view illustrating patterns of folding of an L-shaped flange according to aspects of the present invention.

A press-forming method of an embodiment of the present invention is preferably used for a low-rigidity press-formed product that has a bulging portion in the surface normal direction but that does not have a structure for suppressing an inflow of material around the bulging portion. In a method for manufacturing a press-formed product in an embodiment of the present invention, a blank material is first formed by blanking, from a sheet-shaped material, into a shape corresponding to a developed shape (external shape) of a final product and to which excess material portion is attached (blanking step). Then, the excess material portion of the sheet-shaped material is folded to produce an intermediate formed product with a bent flange portion (first pressing step), and press forming including a bulging process for providing the bulging portion on the intermediate formed product is performed (second pressing step). Finally, the excess material portion is trimmed (trimming step) to form a final product shape. For a complicated part shape, the forming step (the first or second pressing step) and the trimming step may each be divided into a plurality of steps. The press-forming method of the present embodiment includes at least the first pressing step and the second pressing step, and the blank material for the sheet-shaped material according to the present embodiment is used for the first pressing step. The intermediate formed product of the present embodiment is produced in the first pressing step.

In the first pressing step, the excess material portion is folded inside by bending. The excess material portion may be subjected to blanking by extending the blank by the line length of the fold shape. In a case where the contour outline of the developed shape of the product is comprised of straight lines, the excess material portion is preferably folded to form straight sides along with the contour outline (circumscribed around the contour outline) or spaced apart from and parallel to the outline with a flat sheet portion left. Further, in a case where the contour outline of the developed shape of the product is a curve as viewed from above, it is preferable to provide a notch at a part of the excess material portion such that the curve of the contour outline is approximated by folding lines of a polygon. In this case, it is preferable that the polygon formed of the folding lines is provided with excess material portion and folded to form straight sides circumscribed around or spaced apart from the contour outline of the product. The excess material is preferably provided with a notch at a connection portion between adjacent straight sides. With no notches provided, during the process of folding the excess material portion to form the bent flange portion, intersections between the folding lines (connection portions between the straight sides) are subjected to drawing, possibly leading to significantly distorted panel by shrink deformation. The notch is provided in the excess material portion in order to prevent the distortion as described above. The notch limits the first pressing step only to bending deformation to enable a reduction in the radius of curvature of bending, thus increasing bending and unbending resistance to improve the effect of inhibiting the inflow of a material in the second pressing step described below.

The shape obtained by the folding in the first pressing step is an L shape into which the bent flange portion is folded at one ridge line (straight side), a Z shape into which the bent flange portion is folded at two ridge lines, or a shape obtained by combining the L shape and the Z shape. In folding of the flange, the bent flange portion is folded with the flat sheet portion pressed using a cushion pad or the like and prevented from floating during forming in order to prevent the flat sheet portion being curved. A folding angle is not limited, and the bending and unbending resistance increases as a winding angle of the blank increases in the second pressing step. For upward bending, the folding angle is up to 90°. However, the use of a cam mechanism allows the folding angle to be set to 90° or more.

Figure 1B:
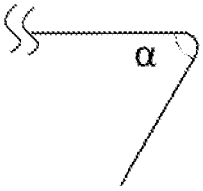
Figure 1C:
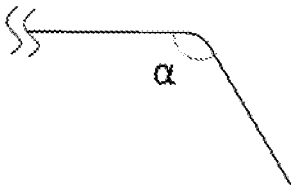
Figure 2A:
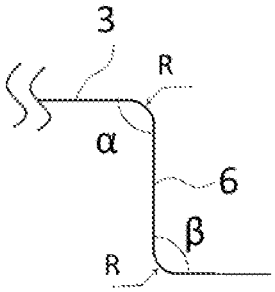
FIG. 2 is a partial cross-sectional view illustrating patterns of folding of a Z-shaped flange according to aspects of the present invention.
Figure 2B:
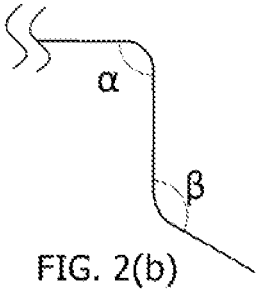
Figure 2C:
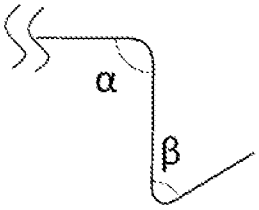
Figure 2D:
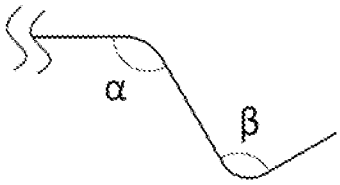
Figure 2E:
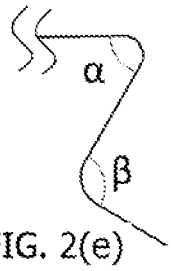
Figure 2F:
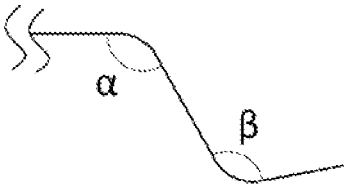
Figure 2G:
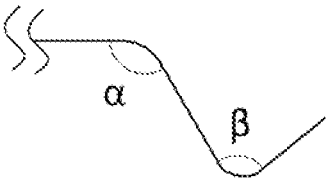
Figure 2H:
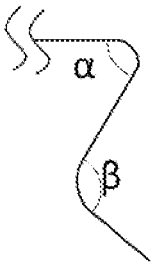
Figure 2I:
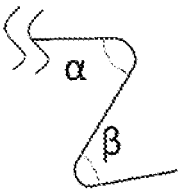

As the shape of the bent flange portion in the first pressing step of the present embodiment, examples of the L shape are schematically illustrated in a partial cross-sectional view in FIG. 1, and examples of the Z shape are schematically illustrated in a partial cross-sectional view in FIG. 2. Note that in FIGS. 1 and 2, a radius of curvature of the bent flange portion is represented by R. The L-shaped bending patterns illustrated in FIG. 1 include a pattern (a) in which an angle $\alpha$ formed between a flat sheet portion 3 and a bent flange portion 6 is the right angle, a pattern (b) in which the angle $\alpha$ is an acute angle, and a pattern (c) in which the angle $\alpha$ is an obtuse angle. The Z-shaped bending patterns illustrated in FIG. 2 include a pattern (a) in which both $\alpha$ and $\beta$ are the right angles, a pattern (b) in which $\alpha$ is the right angle and $\beta$ is an obtuse angle, a pattern (c) in which $\alpha$ is the right angle and $\beta$ is an acute angle, a pattern (d) in which $\alpha$ is an obtuse angle and $\beta$ is the right angle, a pattern (e) in which $\alpha$ is an acute angle and $\beta$ is the right angle, a pattern (f) in which $\alpha$ is an obtuse angle and $\beta$ is an obtuse angle, a pattern (g) in which $\alpha$ is an obtuse angle and $\beta$ is an acute angle, a pattern (h) in which $\alpha$ is an acute angle and $\beta$ is an obtuse angle, and a pattern (i) in which both $\alpha$ and $\beta$ are acute angles.

In the second pressing step, with the folded bent flange portion pressed, a product shape is press-formed by forming including bulging. In the second pressing step as well, forming is performed with the flat sheet portion 3 pressed using a cushion pad or the like and prevented from floating during forming.

In the embodiment, before the blanking step, first, a location into which a large amount of material flows in a conventional press forming may be identified and a blank shape attached with the excess material portion to the contour of the developed shape of the press-formed product may be determined (blank shape determination step), and the determined blank shape may be subjected to blanking from the sheet-shaped material to form a blank material (blanking step). This enables press forming with high material yield and high processing accuracy.

In the blank shape determination step of the present embodiment, first, the location into which an excessive amount of material flows during press forming is determined. The amount of inflow material may be measured by actual measurement in the press-formed product or calculated by CAE (Computer Aided Engineering). The excess material portion is attached to the identified material inflow location to determine the blank shape of the sheet-shaped material for outline blanking. The determined excess material portion includes the length of the bent flange portion required for folding.

Furthermore, in the embodiment, preferably, the shape obtained by the folding in the first pressing step is the Z shape into which the bent flange portion is folded at two ridge lines (straight sides) or a combination of a plurality of Z shapes, and the flat vertical wall portion formed by the folding in the first pressing step is extended in the height direction in the second pressing step. This enables press forming with higher processing accuracy.

Figure 10:
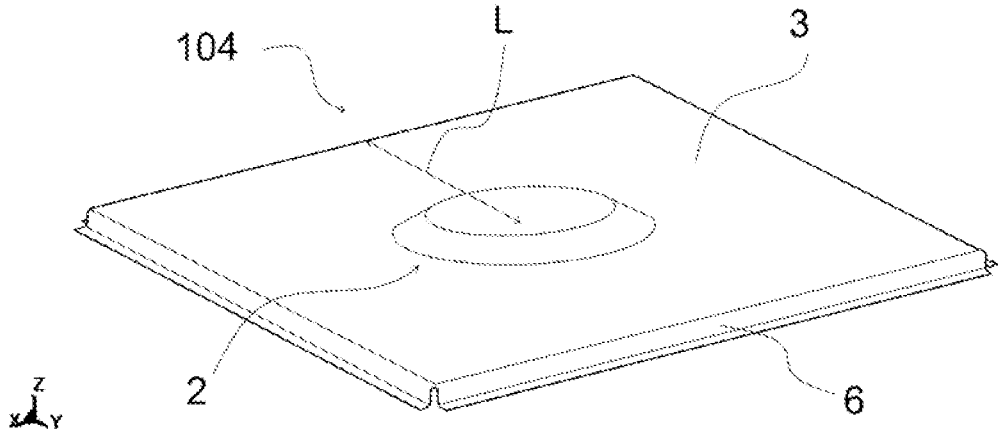
FIG. 10 is a perspective view illustrating a press-formed product after bulging according to Example 3.
Figure 11:
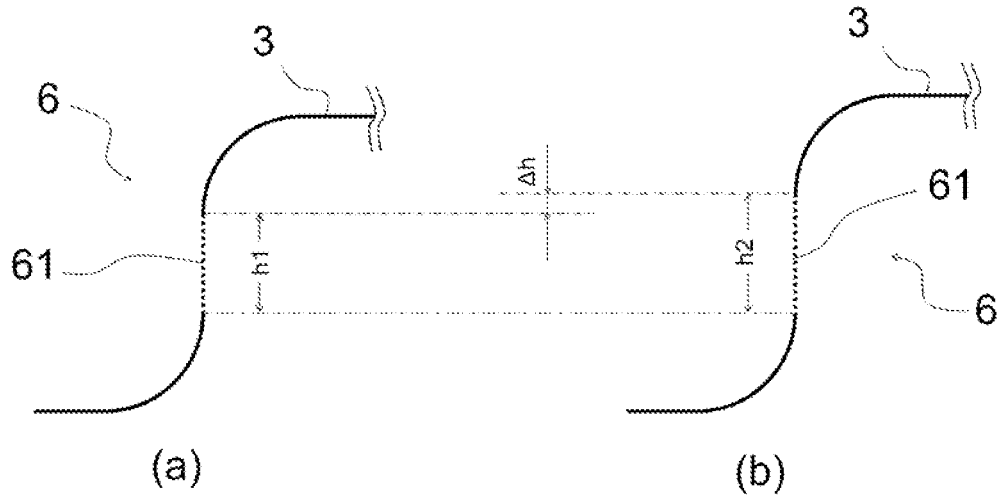
FIG. 11 is a schematic partial cross-sectional view illustrating the state of a flat vertical wall portion of a Z-shaped folding portion after pressing steps according to Example 3.

In the second pressing step of the present embodiment, a height h2 of the flat vertical wall portion of the bent flange portion in a direction orthogonal to the bent flange portion is made longer than a height h1 designed in the first pressing step (see FIG. 11). The difference $\Delta h$ preferably ranges from 0.2 to 1.0% of a typical length L of the flat sheet portion. In this regard, the typical length L of the flat sheet portion is the length of a perpendicular line from the center of a bulging portion to the bent flange portion projected on a plane including the flat sheet portion (see FIG. 10 and FIG. 21).

The reason why the flat vertical wall portion of the bent flange portion is extended in the second pressing step is as follows. After the first press forming, the flat sheet portion causes a slight deflection, which is not eliminated by the bulging in the second pressing step and remains in the flat sheet portion. Thus, the flat sheet portion is made flow toward the flange side on the whole to eliminate the deflection. When the amount of extension $\Delta h$ of the flat vertical wall portion is less than the lower limit, the above-described effect is not exerted. On the other hand, when the amount of extension $\Delta h$ exceeds the upper limit, the bulging portion may be cracked.

In the trimming step, the excess material portion including the bent flange portion and the extension portion of the flat vertical wall attached in the second pressing step is trimmed and removed in accordance with the product external shape.

Aspects of the present invention are suitably applicable to a high-strength steel sheet. In particular, steel sheets of 780 MPa class or higher are likely to suffer from significant springback, and thus aspects of the present invention can be effectively applied to these steel sheets.

Example 1

The present embodiment is applied to a part to be subjected to bulging to form a circular truncated cone shape (a height of 3 mm) in the surface normal direction on the center of a rectangular blank of 300 mm×300 mm. The material is a cold-rolled steel sheet of 980 MPa class (high-tensile steel sheet) and has a sheet thickness of 0.9 mm. Mechanical characteristics thereof includes a yield point (YP) of 620 MPa, a tensile strength (TS) of 1030 MPa, and an elongation (El) of 15%.

Figure 3:
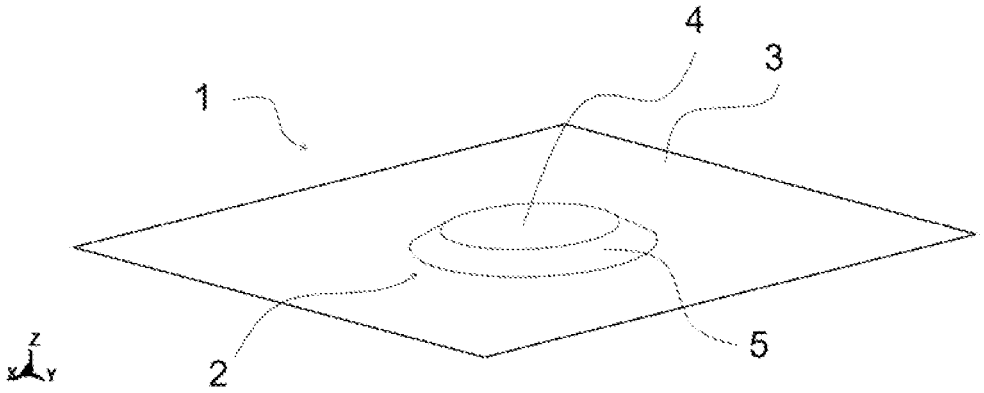
FIG. 3 is a perspective view illustrating a press-formed product according to an embodiment of the present invention.
Figure 4:
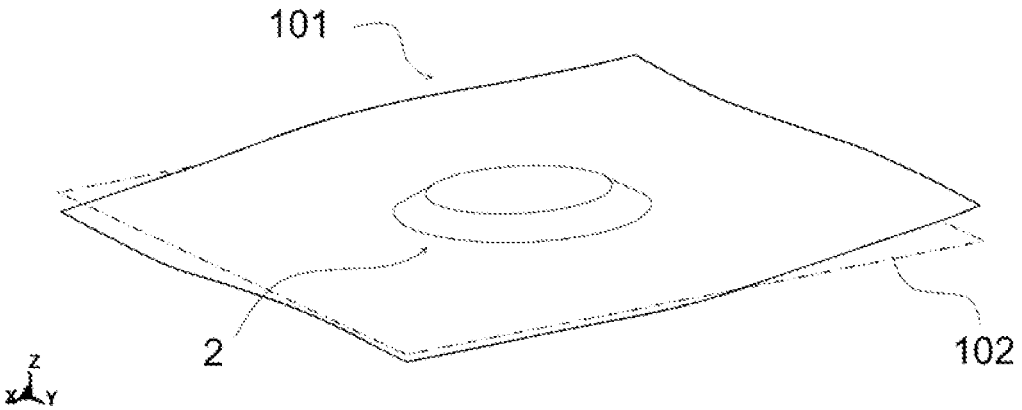
FIG. 4 is a perspective view schematically illustrating a form of the press-formed product after springback.

FIG. 3 is a perspective view illustrating the shape of a press-formed product 1. A bulging portion 2 shaped like a circular truncated cone is formed, by bulging, in the surface normal direction on the center of a rectangular shape. There is a flat sheet portion 3 around the bulging portion 2, and the bulging portion includes a circular bottom surface (punch bottom) 4 in the center and a vertical wall (side wall) 5 around the bottom surface 4. A coordinate system is assumed that it includes an X and a Y axes corresponding to sides of the rectangular flat sheet and a Z axis that is perpendicular to the flat sheet portion 3, the positive side of the Z axis corresponding to a protruding direction of the bulging portion 2. This also applies to the description below. When the present part is press formed by a conventional method, the flat sheet portion 3 is distorted due to springback as illustrated in FIG. 4. FIG. 4 illustrates that a press-formed product 101 after springback is distorted due to rising or falling from an edge shape 102 at a bottom dead center in a Z direction.

Figure 5:
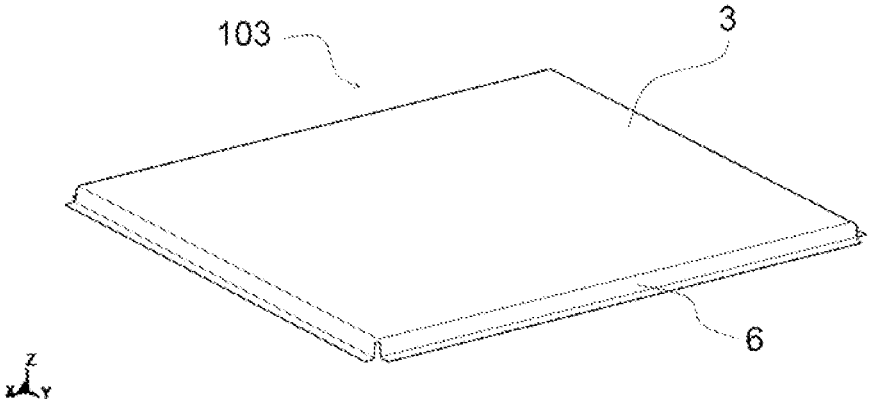
FIG. 5 is a perspective view illustrating an intermediate formed product after folding according to the above-described embodiment.

FIG. 5 is a perspective view of an intermediate formed product 103 after the present embodiment is applied to fold the excess material portion into the bent flange portion 6 in the first pressing step. Folding lines coincide with (are circumscribed around) the contour outline of the product. In the present example, the folding shape is the Z shape, and corresponds to the type in FIG. 2(*a*) where $\alpha=\beta=90°$. Each corner of the rectangle is notched during blanking to prevent the flat sheet portion 3 from being deformed during bending.

Figure 6:
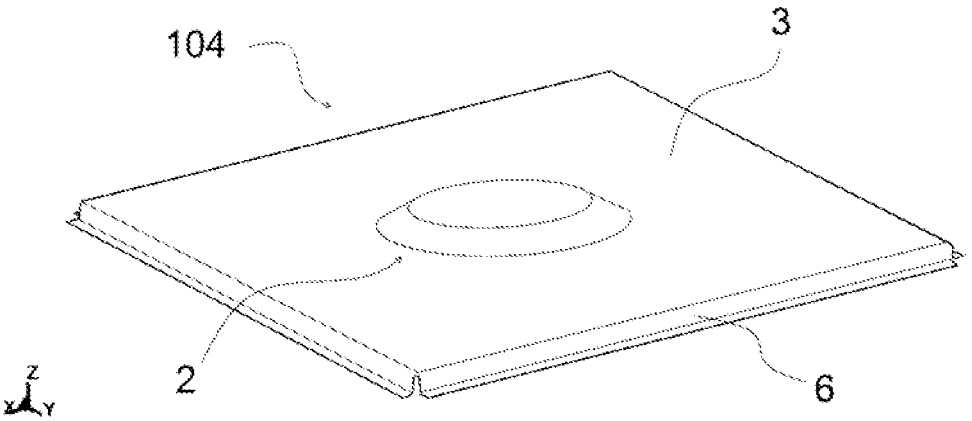
FIG. 6 is a perspective view illustrating a press-formed product after bulging according to the embodiment.

FIG. 6 is a perspective view illustrating a press-formed product 104 on which the bulging portion 2 shaped like a circular truncated cone is formed by bulging in the central portion of the intermediate formed product. Restriction of the folding portion 6 inhibits inflow of the material during the bulging, and no distortion (see FIG. 4) caused by springback is observed in the flat sheet portion 3 as in the conventional methods.

Subsequently, in the trimming step, the flat sheet portion 3 is trimmed in such a manner as to form the rectangular shape in FIG. 3, obtaining the final product.

Figure 7:
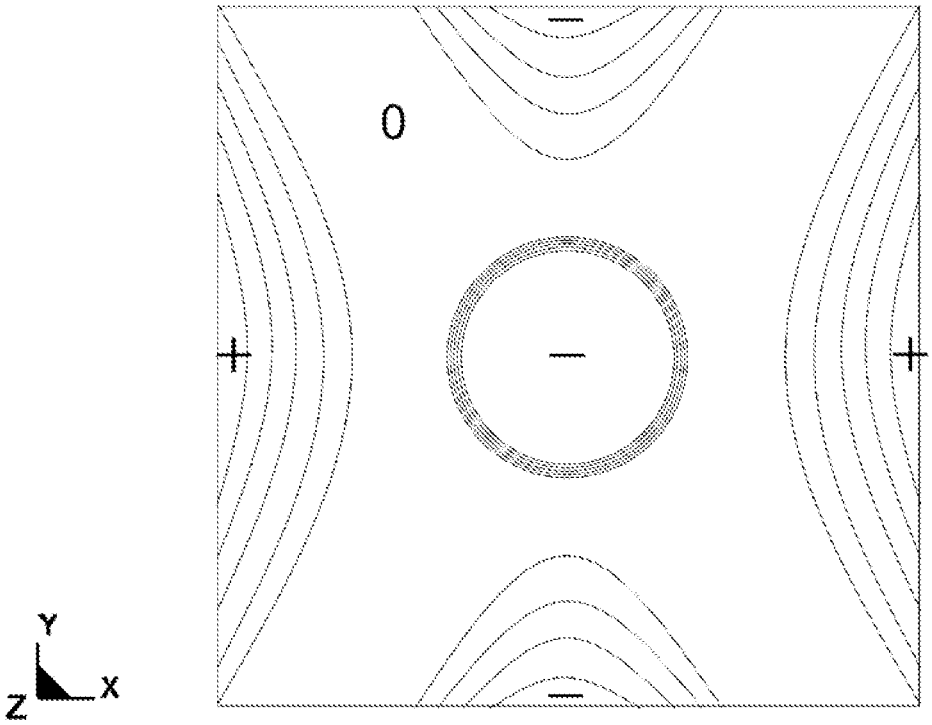
FIG. 7 is a contour map illustrating an example of the amount of springback after conventional press forming.

FIG. 7 is a contour map illustrating an example of the amount of springback after the present part is press formed in accordance with the conventional method. In FIG. 7, (+) denotes positive (protruding side of the bulging portion 2) displacement, and (−) denotes negative displacement, in the Z-axis direction. The amount of rising or falling is large in the central portion of each side of the outline of the rectangular flat sheet portion 3. The largest amount of rising (+ displacement) is 1.5 mm, and the largest amount of falling (− displacement) is 1.9 mm.

Figure 8:
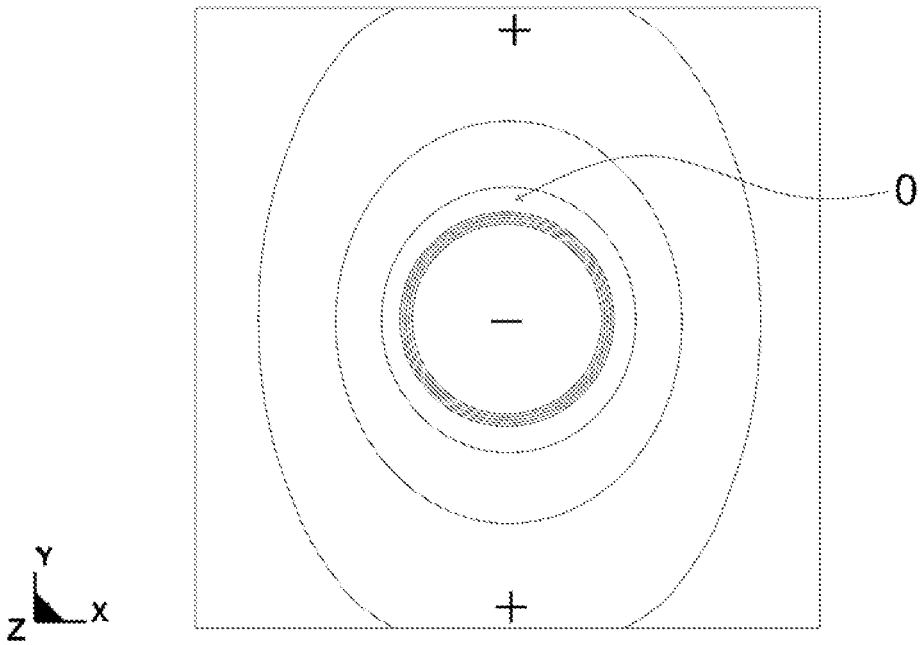
FIG. 8 is a contour map illustrating the amount of springback after press forming according to the embodiment.

FIG. 8 is a contour map illustrating an example of the amount of springback of a press-formed product to which aspects of the present invention are applied. The expression of the displacement in the Z-axis direction is the same as the expression in FIG. 7. The sides of the outline of the rectangular flat sheet portion 3 are hardly distorted, and the displacement contour lines in the Z direction are close to concentric circles. The largest amount of rising (+ displacement) is 0.5 mm, and the largest amount of falling (− displacement) is 0.4 mm. This indicates that the method according to aspects of the present invention significantly improves distortion of the panel compared to the conventional method.

Example 2

Figure 9:
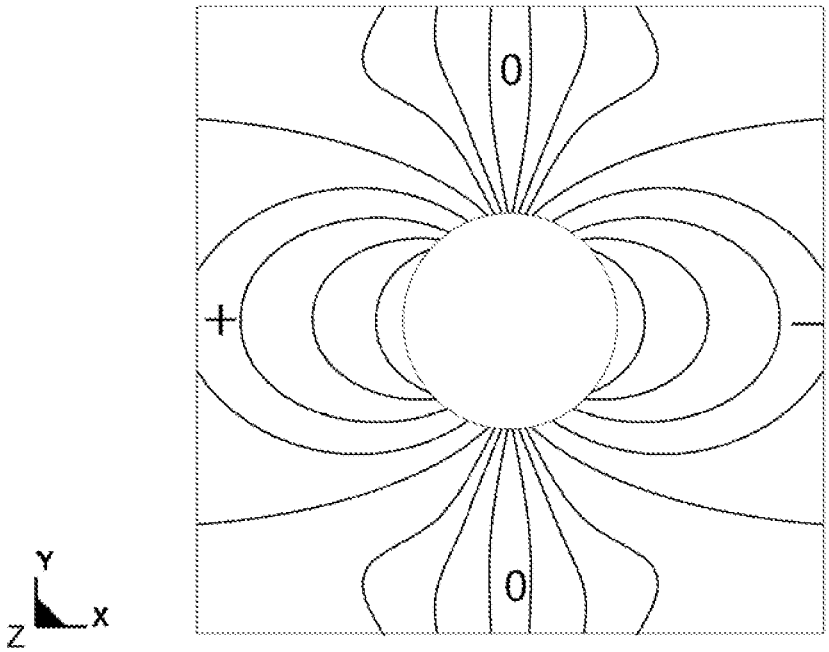
FIG. 9 is a contour map illustrating the amount of the X-direction displacement after conventional press forming.

Before the present embodiment is applied to a press-formed product similar to that in Example 1, a location into which a large amount of material in press forming flows is identified in advance. FIG. 9 is a contour map illustrating the amount of displacement in the X direction in a case where press forming is performed by a conventional method. In FIG. 9, (+) denotes positive (rightward in FIG. 9) displacement, and (−) denotes negative (leftward in FIG. 9) displacement, in the X direction. The amount of inflow material can be evaluated based on the amount of displacement after press forming. The present part has a vertically and laterally symmetric shape, and the amount of inflow material did not substantially vary with direction. Thus, the present embodiment is applied to the entire perimeter. The blanking step and the subsequent steps are similar to the corresponding steps in Example 1.

Example 3

Before the present embodiment is applied to a press-formed product similar to that in Example 1, the bent flange portion is formed into a Z shape, and the flat vertical wall portion formed by the folding in the first pressing step is extended in the height direction in the second pressing step. FIG. 10 is a perspective view illustrating the press-formed product 104 where the bulging portion 2 shaped like a circular truncated cone is formed by bulging in the central portion of the intermediate formed product by the second press forming. Restriction of the folding portion 6 inhibits inflow of the material during the bulging, and no distortion (see FIG. 4) caused by springback is observed in the flat sheet portion 3 as in a conventional method. The typical length L of the flat sheet portion illustrated in FIG. 10 is the length of a perpendicular line from the center of the bulging portion 2 to the bent flange portion 6 projected on a plane including the flat sheet portion 3.

FIG. 11(*a*) is a schematic partial cross-sectional view illustrating the state of a flat vertical wall portion 61 of a Z-shaped folding portion after the first pressing step, and FIG. 11(*b*) is a schematic partial cross-sectional view illustrating the state of the flat vertical wall portion 61 of the Z-shaped folding portion after the second pressing step. In the second pressing step, the height h2 of the flat vertical wall portion 61 of the bent flange portion in a direction orthogonal to the bent flange portion 6 is designed at 3.5 mm, which is larger than the height h1=3.0 mm designed in the first pressing step. The difference $\Delta h=0.5$ mm is 0.33% of the typical length L=150 mm of the flat sheet portion illustrated in FIG. 10.

Subsequently, in the trimming step, the flat sheet portion 3 is trimmed in such a manner as to form the rectangular shape in FIG. 3, obtaining the final product.

Figure 12:
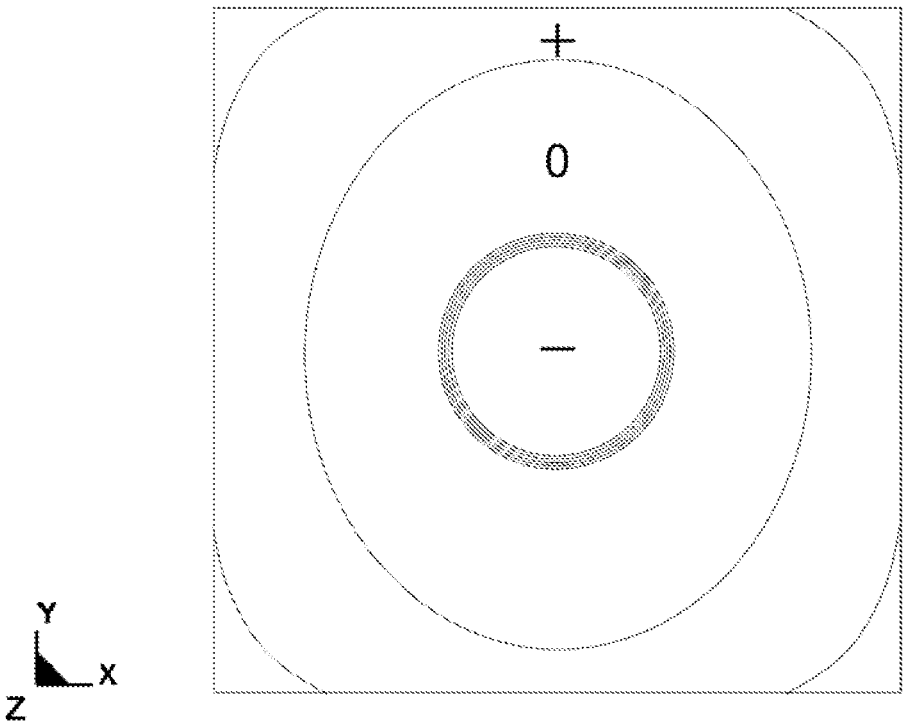
FIG. 12 is a contour map illustrating the amount of springback after press forming according to Example 3.

FIG. 12 is a contour map illustrating an example of the amount of springback of a press-formed product in the present example. The expression of the displacement in the Z-axis direction is the same as the expression in FIG. 7. The side of the outline of the rectangular flat sheet portion 3 is hardly distorted, and the displacement contour lines in the Z direction are close to concentric circles. The largest amount of rising (+ displacement) is 0.3 mm, and the largest amount of falling (− displacement) is 0.3 mm. This indicates that the method according to aspects of the present invention significantly improves distortion of the panel compared to a conventional method.

Example 4

Then, the present embodiment is applied to formation of an actual part referred to as an A pillar lower inner. This part is approximately 700 mm in length and 400 mm in width. The material is a 980-MPa class cold-rolled steel sheet (high-tensile steel sheet) and had a sheet thickness of 1.2 mm. Mechanical characteristics includes a yield point (YP) of 620 MPa, a tensile strength (TS) of 1030 MPa, and an elongation (El) of 15%.

Figure 13:
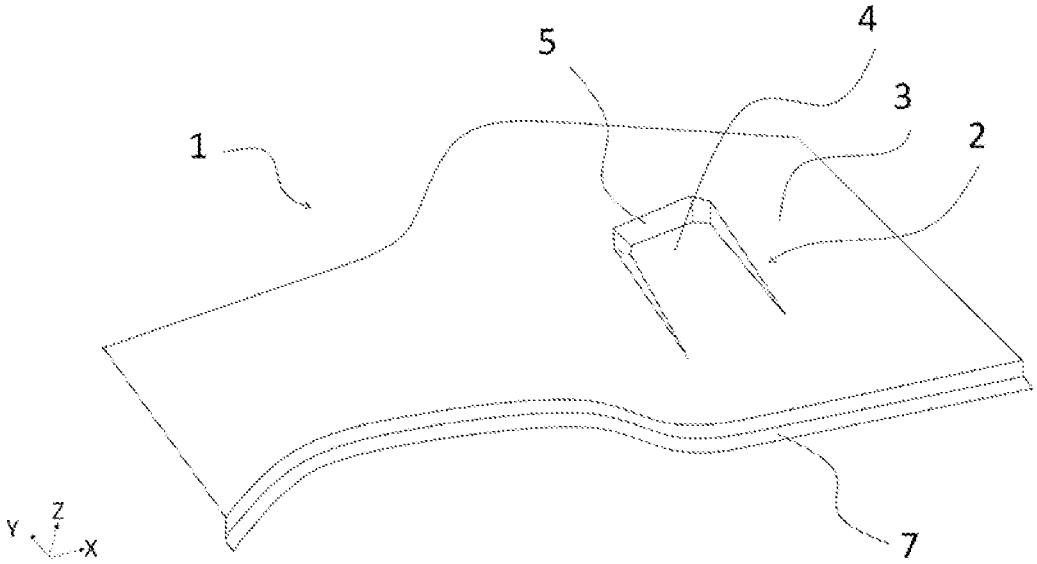
FIG. 13 is a perspective view illustrating a press-formed product according to another embodiment of the present invention.
Figure 14:
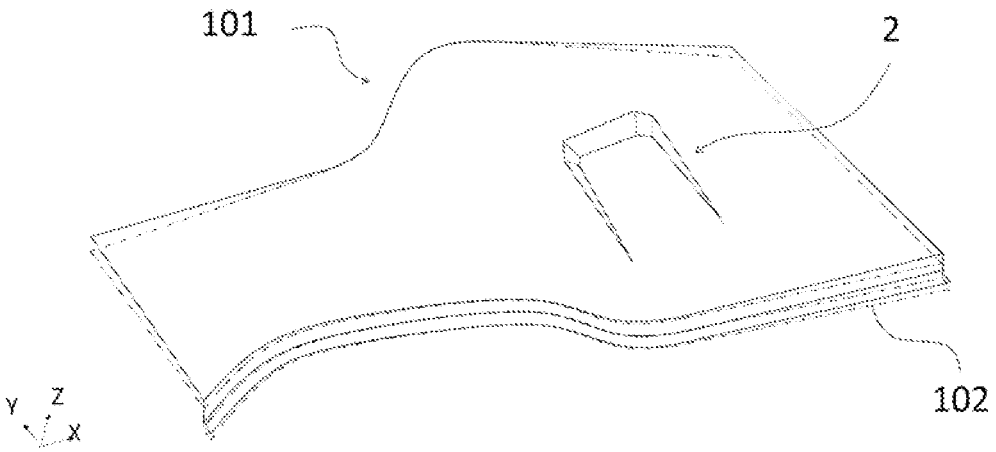
FIG. 14 is a perspective view schematically illustrating a form of the press-formed product after springback.

FIG. 13 is a perspective view illustrating the shape of the press-formed product 1. The press-formed product 1 has a larger width on a right side in a longitudinal direction, and includes, near the center of the width of the right side, the bulging portion 2 extending in the surface normal direction. A coordinate system is assumed in which an XY plane corresponds to the flat sheet portion 3, an X axis extends rightward in the longitudinal direction, a Y axis extends upward in the width direction, and a Z axis is perpendicular to the flat sheet portion, the positive side of the Z axis corresponding to the protruding direction of the bulging portion 2. This also applies to the description below. A step portion 7 with a Z-shaped cross section is provided on the near side in the figure (on a side with smaller Y values). Press forming the present part in accordance with the conventional method leads to distortion of the flat sheet portion 3 due to springback as illustrated in FIG. 14. FIG. 14 illustrates that the press-formed product 101 after springback is distorted due to rising (backward of the part) or falling (upward and downward of the part) from the edge shape 102 at the bottom dead center in the Z direction.

Figure 15:
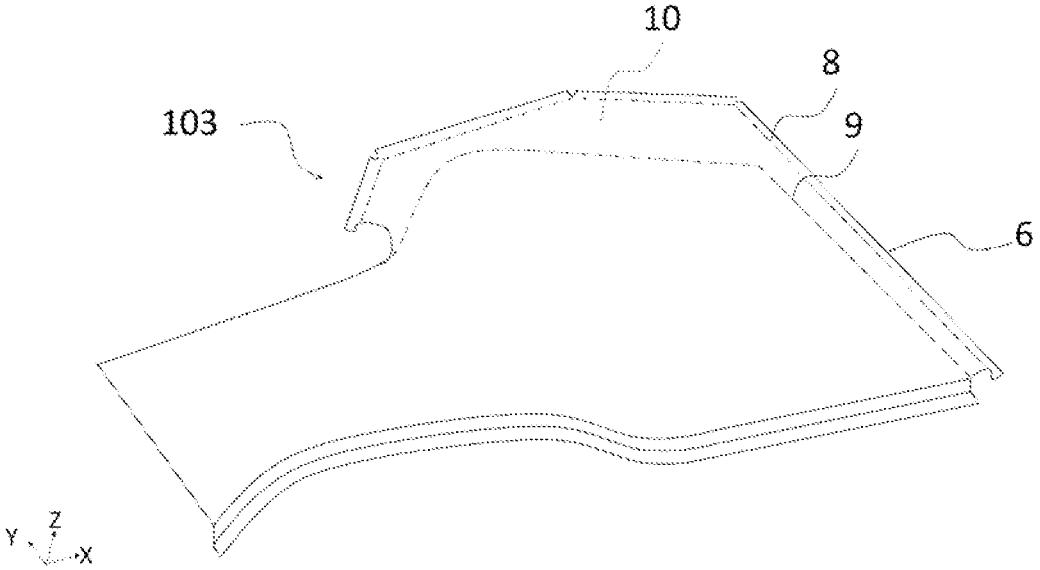
FIG. 15 is a perspective view illustrating an intermediate formed product after folding according to another embodiment described above.

FIG. 15 is a perspective view of an intermediate formed product 103 obtained by folding into the Z shape (FIG. 2(*a*)) in the first pressing step as a result of application, to the present part, of the press-forming method according to aspects of the present invention. In the part of the present example, a large amount of material flows into the periphery of the bulging shape. Thus, in FIG. 15, folding lines 8 are configured to form straight sides parallel to a linear outline 9 on the right side of the product (side with larger X values), and a curved portion of the outline 9 on the upper right side of the part (side with larger Y values and larger X values) is approximated by three folding lines 8 as straight sides. The excess material portion is notched at the intersection between the folding lines 8 (connection portion between the straight sides). Thus, an excess material portion 10 is formed in the flat sheet portion 3 between the contour outline 9 of the product and the folding lines 8. In this example, before the first press forming, a step working is executed on the near side in the figure. (side with smaller Y values).

Figure 16:
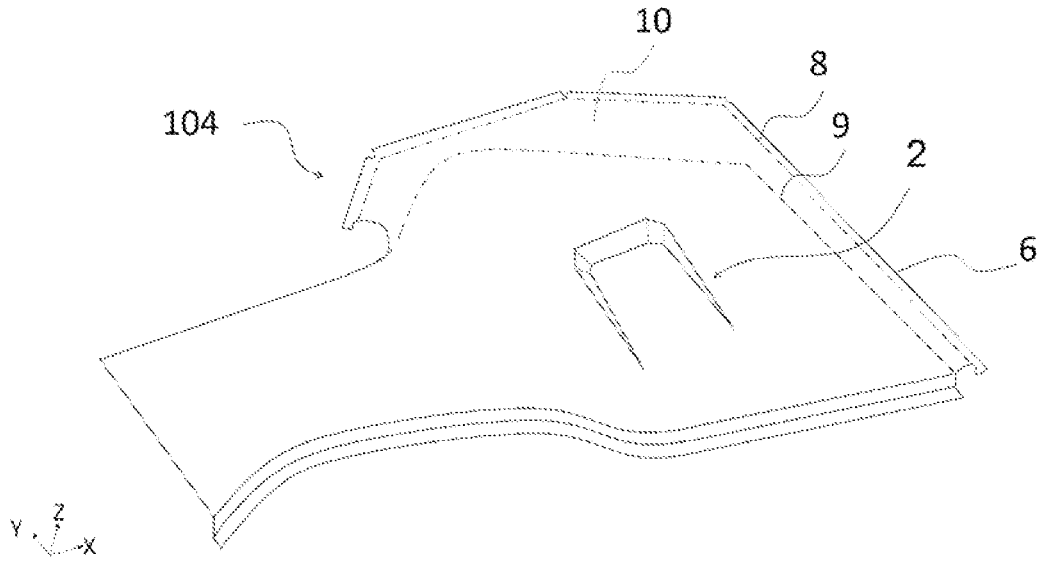
FIG. 16 is a perspective view illustrating a press-formed product after bulging according to another embodiment described above.

FIG. 16 is a perspective view illustrating the press-formed product 104 obtained by bulging the intermediate formed product in the second press forming. Subsequently, the excess material portion 10 is trimmed along the contour outline 9 of the product to form a press-formed product 1 illustrated in FIG. 13.

Figure 17:
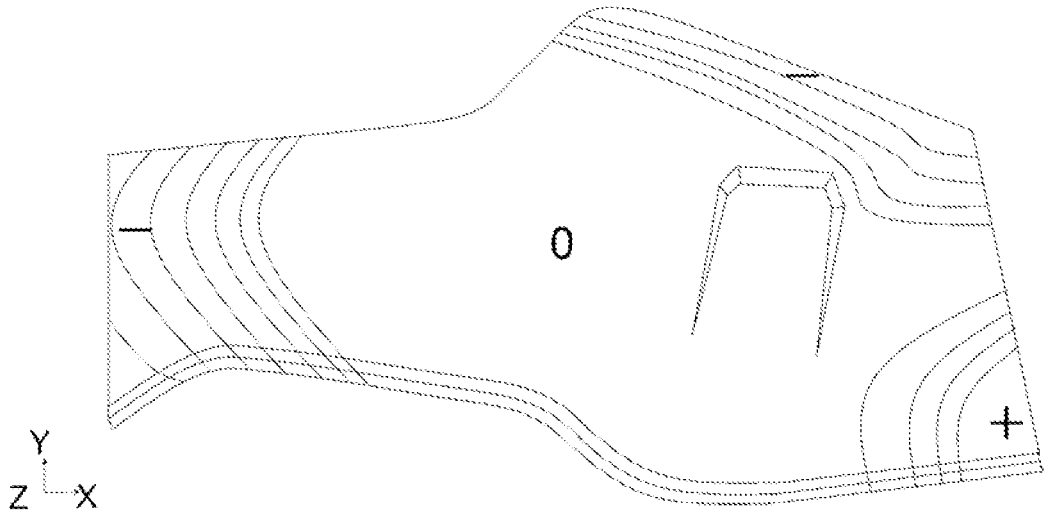
FIG. 17 is a contour map illustrating an example of the amount of springback after conventional press forming.
Figure 18:
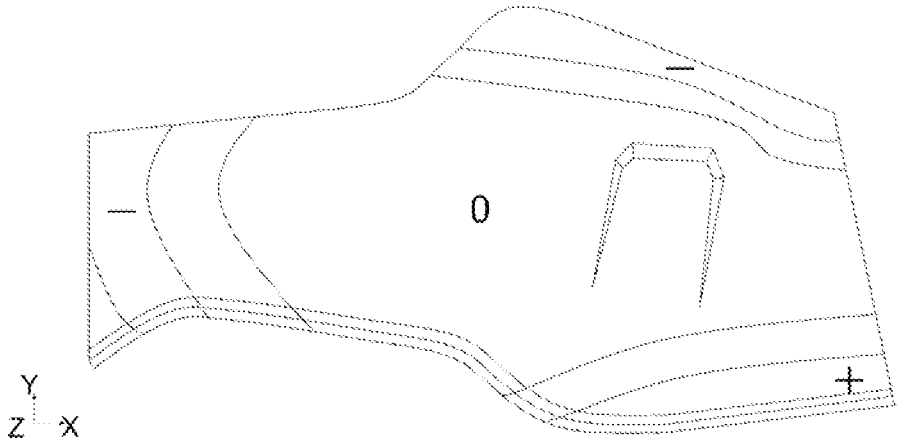
FIG. 18 is a contour map illustrating the amount of springback after press forming according to another embodiment described above.

As is the case with Example 1, FIG. 17 is a contour map of the amount of springback after press forming in accordance with the conventional method, and FIG. 18 is a contour map of the amount of springback after press forming according to aspects of the present invention. Both figures are top views, and the amount of springback is evaluated in terms of displacement in the Z direction. The expression of the displacement in the Z-axis direction is the same as the expression in FIG. 7. For the amount of springback resulting from the conventional method, the largest amount of rising (+ displacement) is 3.8 mm, and the largest amount of falling (− displacement) is 7.1 mm. Application of the press-forming method according to aspects of the present invention improves the amounts of rising and falling, and the largest amount of rising (+ displacement) is 3.4 mm, and the largest amount of falling (− displacement) is 3.9 mm.

Example 5

Figure 19:
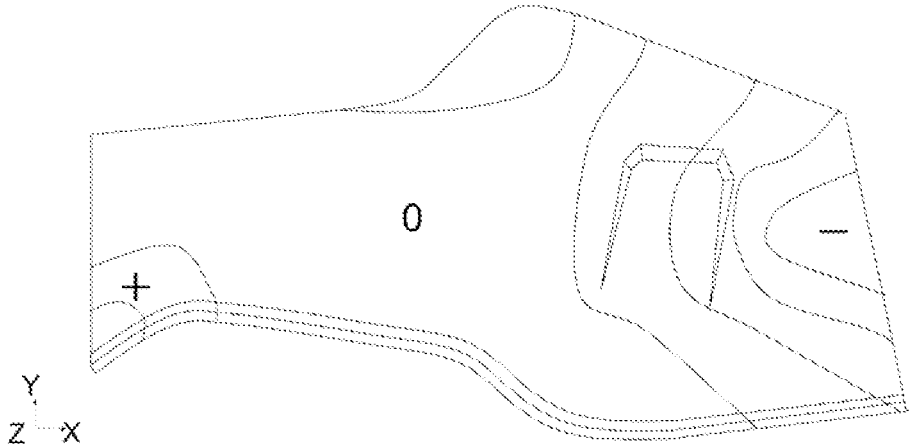
FIG. 19 is a contour map illustrating the amount of X-direction displacement after conventional press forming.
Figure 20:
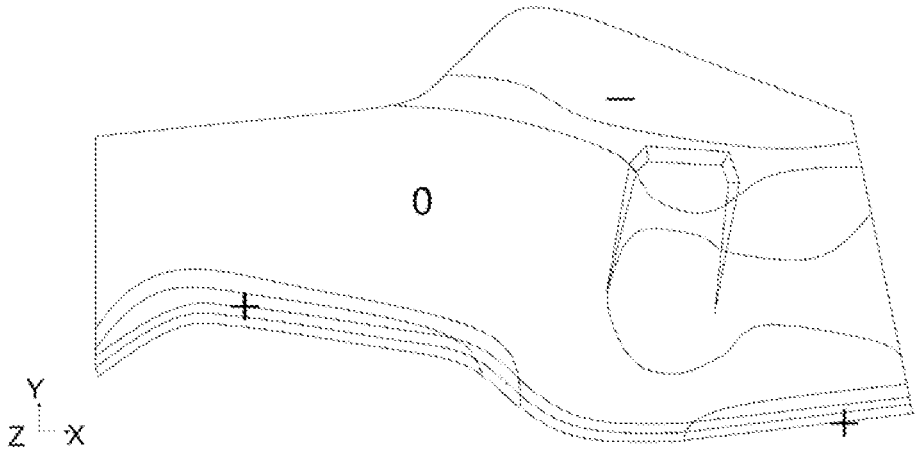
FIG. 20 is a contour map illustrating the amount of Y-direction displacement after conventional press forming.

Before application of the present embodiment to a press-formed product similar to that in Example 4, locations into which a large amount of material in press forming flows are identified in advance. FIG. 19 is a contour map illustrating the amount of displacement in the X direction in a case where the present part is press formed by the conventional method. FIG. 20 is also a contour map illustrating the amount of displacement in the Y direction in a case where the present part is press formed by the conventional method. In each of FIGS. 19 and 20, (+) denotes positive displacement, and (−) denotes negative displacement. The amount of inflow material is large on the upper right side (side with larger Y values and larger X values) and the front side (side with larger X values) of the part, and thus the present embodiment is applied to the upper right side and the front side of the part to attach the excess material portion. The blanking step and the subsequent steps are similar to the corresponding steps in Example 1.

Example 6

Figure 21:
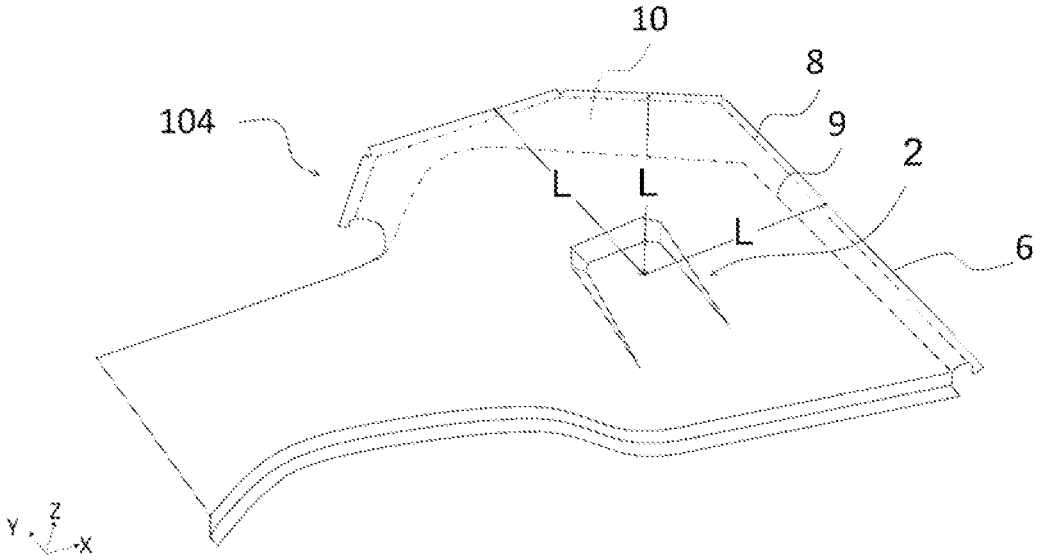
FIG. 21 is a perspective view illustrating a press-formed product after bulging according to Example 6.

Before application of the present embodiment to a press-formed product similar to that in Example 4, the bent flange portion is formed into a Z shape, and the flat vertical wall portion formed by the folding in the first pressing step is extended in the height direction in the second pressing step. FIG. 21 is a perspective view illustrating the press-formed product 104 where the intermediate formed product is subjected to bulging in the second press forming. Here, the typical length L of the flat sheet portion is the length of a perpendicular line from the center of the bulging portion 2 to the bent flange portion 6 projected on a plane including the flat sheet portion 3. As is the case with Example 3, in the second pressing step, the height h2 of the flat vertical wall portion of the bent flange portion in the direction orthogonal to the bent flange portion is designed at 3.5 mm, which is larger than the height h1=3.0 mm designed in the first pressing step. The difference Δh=0.5 mm ranged from 0.20 to 0.25% of the typical length L=200 to 250 mm of the flat sheet portion.

Subsequently, the excess material portion 10 is trimmed along the contour outline 9 of the product to form a press-formed product 1 illustrated in FIG. 9.

Figure 22:
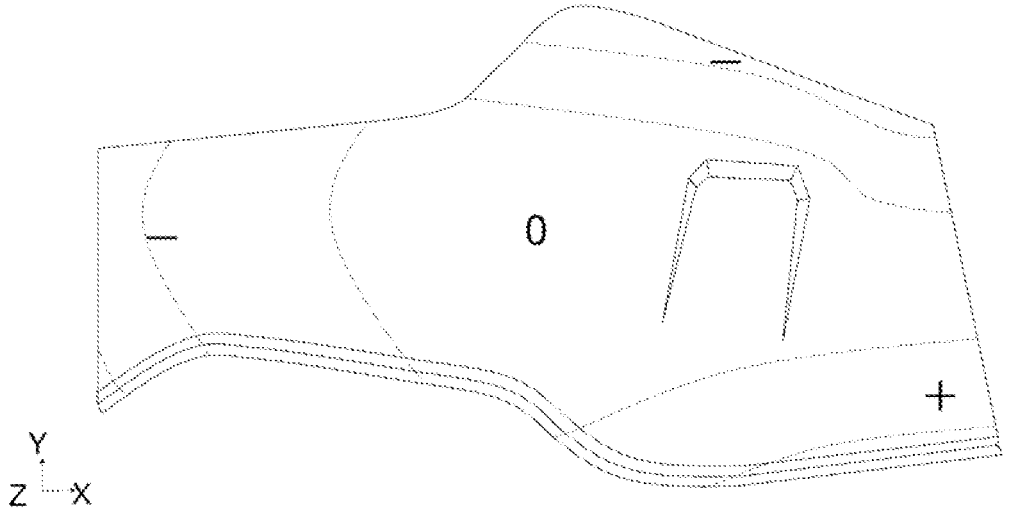
FIG. 22 is a contour map illustrating the amount of springback after press forming according to Example 6.

As is the case with Example 1, FIG. 22 is a contour map of the amount of springback after press forming according to aspects of the present invention. FIG. 22 is a top view, and the amount of springback is evaluated in terms of displacement in the Z direction. The expression of the displacement in the Z-axis direction is the same as the expression in FIG. 7. For the amount of springback resulting from the conventional method illustrated in FIG. 17, the largest amount of rising (+ displacement) is 3.8 mm, and the largest amount of falling (− displacement) is 7.1 mm. Application of the press-forming method according to aspects of the present invention improves the amounts of rising and falling, and the largest amount of rising (+ displacement) is 3.0 mm, and the largest amount of falling (− displacement) is 3.2 mm.

The above description is based on the illustrated example. However, the press-forming method, the blank material of the sheet-shaped material, the method for manufacturing a press-formed product, and the press-formed product in accordance with aspects of the present invention are not limited to the above-described examples, and may be changed as appropriate without departing from the scope of claims. For example, the shape of the press-formed product may be other than the shapes illustrated in FIG. 2 and FIG. 13, and the shape of the bent flange portion may be other than the shapes illustrated in FIG. 5 and FIG. 15.

INDUSTRIAL APPLICABILITY

Thus, according to the press-forming method, the blank material of the sheet-shaped material, the intermediate formed product, the method for manufacturing a press-formed product, and the press-formed product in accordance with aspects of the present invention, springback can be efficiently suppressed. The technique according to aspects of the present invention is suitably applied to parts having formation accuracy affected by inflow of a material during press forming.

REFERENCE SIGNS LIST

1 Press-formed product
2 Bulging portion
3 Flat sheet portion
4 Punch bottom (bottom surface)
5 Vertical wall (side wall)
6 Bent flange portion
61 Flat vertical wall portion
7 Step portion
8 Folding line
9 Contour outline of product
10 Excess material portion
101 Press-formed product after springback
102 Edge shape of bottom dead center
103 Intermediate formed product after bending
104 Press-formed product after bulging

The invention claimed is:

1. A press-forming method, characterized in that
the press-forming method comprises
a first pressing step of folding an excess material portion provided in a sheet-shaped material to form straight sides into an intermediate formed product with a bent flange portion, and
a second pressing step of performing press forming including bulging to provide a bulging portion on the intermediate formed product.

2. The press-forming method according to claim 1, wherein
the press-forming method comprises, before the first pressing step, a blank shape determination step of determining, in accordance with a previously identified amount of inflow material during press forming, a blank shape in which the excess material portion is added to a contour outline of a developed shape of a press-formed product.

3. The press-forming method according to claim 2, wherein
in the first pressing step, the excess material portion is folded to form straight sides that are circumscribed around or spaced apart from a contour outline of the developed shape of the press-formed product.

4. The press-formed method according to claim 2, wherein
the excess material portion of the blank material of the sheet-shaped material is provided with a notch at a connection portion between adjacent straight sides.

5. The press-forming method according to claim 2, wherein
the bent flange portion has a Z-shaped cross section, and
a flat vertical wall portion resulting from the folding in the first pressing step is extended in a height direction in the second pressing step.

6. The press-forming method according to claim 5, wherein
an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion when projected on a plane including the flat sheet portion.

7. The press-forming method according to claim 1, wherein
the bent flange portion has an L- or a Z-shaped cross section.

8. The press-forming method according to claim 1, wherein
the bent flange portion has a Z-shaped cross section, and
a flat vertical wall portion resulting from the folding in the first pressing step is extended in a height direction in the second pressing step.

9. The press-forming method according to claim 8, wherein
an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion when projected on a plane including the flat sheet portion.

10. The press-formed method according to claim 1, wherein
the excess material portion of the sheet-shaped material as a blank material is provided with a notch at a connection portion between adjacent straight sides.

11. A method for manufacturing, characterized in that the method comprises:
a blanking step of blanking a sheet-shaped material into a shape in which an excess material portion is added to a contour outline of a developed shape of a press-formed product,
a first pressing step of folding the excess material portion to form straight sides into an intermediate formed product with a bent flange portion,
a second pressing step of performing press forming including bulging in which a bulging portion is provided on the intermediate formed product, and
a trimming step of trimming the excess material portion.

12. The method for manufacturing according to claim 11, wherein
the method comprises, before the blanking step, a blank shape determination step of determining a blank shape having a shape in which the excess material portion is added to a contour outline of the developed shape of the press-formed product, in accordance with a pre-specified amount of inflow material during press forming.

13. The method for manufacturing according to claim 12, wherein
the bent flange portion has a Z-shaped cross section, and
a flat vertical wall portion resulting from the folding in the first pressing step is extended in a height direction in the above-described second pressing step.

14. The method for manufacturing according to claim 13, wherein an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion projected on a plane including the flat sheet portion.

15. The method for manufacturing according to claim 11, wherein the bent flange portion has an L- or a Z-shaped cross section.

16. The method for manufacturing according to claim 11, wherein the bent flange portion has a Z-shaped cross section, and a flat vertical wall portion resulting from the folding in the first pressing step is extended in a height direction in the above-described second pressing step.

17. The method for manufacturing according to claim 16, wherein an extended height Δh of the flat vertical wall portion ranges from 0.2 to 1.0% of a typical length L of a flat sheet portion connected to the corresponding bent flange portion, where the typical length L of the flat sheet portion is a length of a perpendicular line from a center of the bulging portion to the bent flange portion projected on a plane including the flat sheet portion.

18. The method for manufacturing according to claim 11, wherein in the first pressing step, the excess material portion is folded to form straight sides that are circumscribed around or spaced apart from a contour outline of the developed shape of the press-formed product.

* * * * *